US009212461B2

(12) United States Patent
Putre

(10) Patent No.: US 9,212,461 B2
(45) Date of Patent: Dec. 15, 2015

(54) SNOW SHOVEL

(71) Applicant: Mary Putre, New Hyde Park, NY (US)

(72) Inventor: Mary Putre, New Hyde Park, NY (US)

( * ) Notice: Subject to any disclaimer, the term of this patent is extended or adjusted under 35 U.S.C. 154(b) by 0 days.

(21) Appl. No.: 14/039,359

(22) Filed: Sep. 27, 2013

(65) Prior Publication Data

US 2015/0091314 A1 Apr. 2, 2015

(51) Int. Cl.
*A01B 1/02* (2006.01)
*A01B 1/22* (2006.01)
*E01H 5/02* (2006.01)

(52) U.S. Cl.
CPC ..... *E01H 5/02* (2013.01)

(58) Field of Classification Search
CPC ..... E01H 5/02; B25G 3/02; A01B 1/026
USPC ..... 294/54.5, 57–58
See application file for complete search history.

(56) References Cited

U.S. PATENT DOCUMENTS 226,351 A * 4/1880 Reddick ..... 209/419
1,803,006 A * 4/1931 Davis ..... 294/7
4,264,096 A * 4/1981 Barnett ..... 294/58
5,054,830 A * 10/1991 Nisenbaum ..... 294/58
5,069,026 A * 12/1991 Johnson ..... 56/400.11
5,133,582 A * 7/1992 Rocha ..... 294/58
5,417,463 A * 5/1995 DiPaola ..... 294/7
5,826,929 A * 10/1998 Tisbo et al. ..... 294/54.5
D434,287 S * 11/2000 Spear ..... D8/10
D441,623 S * 5/2001 Storlie ..... D8/10
6,463,727 B2 * 10/2002 Blyth ..... 56/400.11
6,497,439 B1 * 12/2002 Guo ..... 294/54.5

* cited by examiner

*Primary Examiner* — Stephen Vu
(74) *Attorney, Agent, or Firm* — Richard B. Klar, Esq.; Law Office Richard B. Klar

(57) ABSTRACT

An improved snow shovel for reducing the suction of snow to shovel while still maintaining the overall strength of the shovel. The improved snow shovel has a face or blade scoop portion that has an array of vertical or longitudinally extending slots or slits that penetrate through the entire blade scoop portion of the snow shovel. The array is arranged with the slots aligned vertically in a top to bottom arrangement. The slots are disposed in a set of preferably one to two slots per set. The sets of slots are arranged in a symmetric pattern on the face of the shovel to ensure uniform distribution of the reduction of snow to the shovel and to ensure uniformity of the overall strength of the shovel. The shovel face can be flat or curved.

14 Claims, 5 Drawing Sheets

SNOW SHOVEL

BACKGROUND

1. Field

The present invention relates to an improved snow shovel. In particular, the present invention relates to an improved snow shovel designed and configured to facilitate the removal of snow from the shovel by reducing the suction of the snow to the shovel while still providing additional support for the overall strength of the shovel.

2. The Related Prior Art

Snow shovels are necessary and are typically employed by business and home owners to remove snow from the entrance and surrounding areas of their building structures. The shoveling of snow can be a tedious and tiresome task. This is often exasperated by the fact that snow tends to adhere by suction to the face of the shovel on which it is deposited during shoveling. It becomes difficult to remove all the snow from the face of the shovel and thus the shovel can only accommodate limited amounts of snow. In addition repeated shoveling with snow on remaining on the face of the shovel from prior shoveling efforts makes the shovel heavier to handle and tires the user faster.

It would be desirable to provide an improved snow shovel that can reduce the suction of the snow to the face of the shovel and overcome the aforementioned problems. It would also be desirable to provide such an improved shovel that is configured and designed to reduce the suction of snow to shovel while still maintaining the overall strength of the shovel.

SUMMARY

The present invention provides for an improved snow shovel that is configured and designed to reduce the suction of snow to shovel while still maintaining the overall strength of the shovel. The present invention provides of an improved snow shovel having a face or blade scoop portion that has an array of vertical or longitudinally extending slots or slits that penetrate or go through the entire blade scoop portion of the snow shovel where the array is arranged with the slots aligned vertically in a top to bottom arrangement. The slots are disposed in a set of preferably one to two slots per set. The sets of slots are arranged in a side to side fashion along the width of the face of the shovel. The spacing of the slots in each set is less than the spacing between the sets to ensure for support for the overall strength of the shovel strength. Also the lengths of the slots are only preferably no more than 75 percent of the length of the shovel face to also ensure for the overall strength of the shovel. The sets of slots are arranged in a symmetric pattern on the face of the shovel to ensure uniform distribution of the reduction of snow to the shovel and to ensure uniformity of the overall strength of the shovel. In addition an additional metal edge is provided horizontally along the bottom edge and is arranged for supporting the shovel and cutting or breaking ice and is attached to the horizontal edge of the shovel preferably with rivets.

In one embodiment the shovel face is flat. In another embodiment of the present invention the snow shovel has a curved shovel face or scoop portion in which beveled raised areas are provided to define recesses within which one of more of the slots are located. The beveled raised areas provide for further reduction of snow to shovel and also provide for additional support for overall shovel strength.

BRIEF DESCRIPTION OF THE DRAWINGS

FIGS. 6A, 6B and 6C show another embodiment for the handle utilizing two handles; in which:

FIG. 6A shows a first handle having a pole coupled and held in place by two c-clamps;

FIG. 6B shows a second handle having a pole positioned at an angle from the pole of the first handle and connected by a bolt going through one of the two c clamps;

FIG. 6C shows the second handle that can be adjusted by tightening or loosening the bolt.

DETAILED DESCRIPTION OF THE PREFERRED EMBODIMENTS

Figure 7:
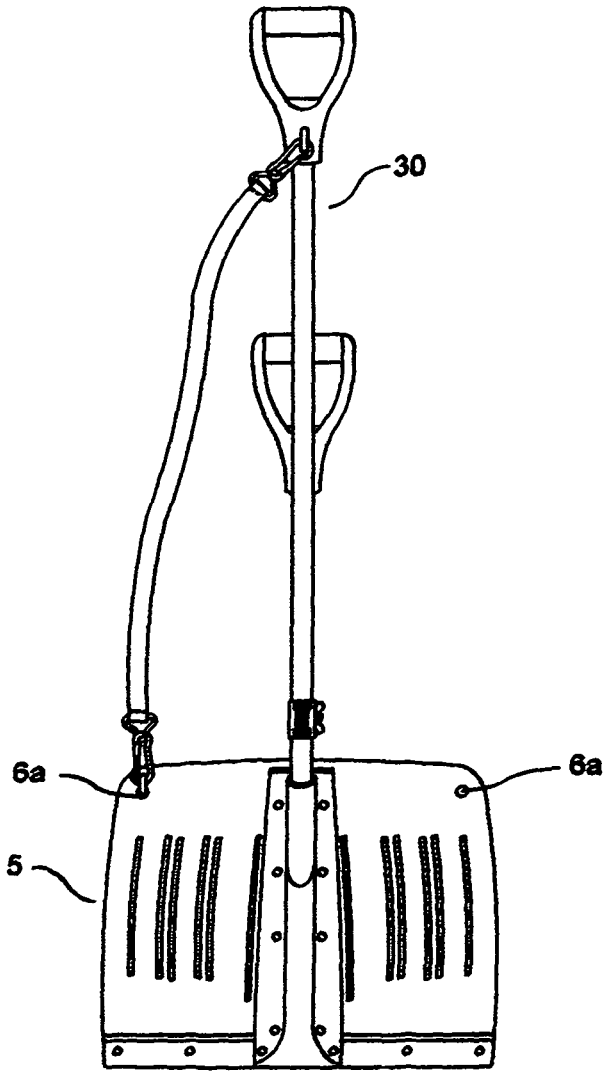
FIG. 7 shows a strap attachment for connecting a hole in the top edge of the shovel face to a ring on top of the handle for carrying the shovel.

Referring now to the drawings of FIGS. 1-5, FIG. 1 shows the front face or portion of an embodiment of the snow shovel of the present invention. The present invention provides of an improved snow shovel 5 having a face or blade scoop portion 6 that has an array of vertical or longitudinally extending slots or slits 7 that penetrate or go through the entire blade scoop portion 6 of the snow shovel 5 where the array is arranged with the slots 7 aligned vertically in a top to bottom arrangement. The slots 7 are disposed in a set 8 of preferably one to two slots 7 per set 8. The sets 8 of slots are arranged in a side to side fashion along the width of the face 6 of the shovel 5. The spacing of the slots 7 in each set 8 is less than the spacing between the sets 8 to ensure for support for the overall strength of the shovel 5 strength. Also the lengths of the slots 7 are only preferably no more than 75 percent of the length of the shovel face 6 to also ensure for the overall strength of the shovel 5. The sets 8 of slots 7 are arranged in a symmetric pattern on the face 6 of the shovel 5 to ensure uniform distribution of the reduction of snow to the shovel 5 and to ensure uniformity of the overall strength of the shovel 5. In addition an additional metal edge 9 is preferably provided horizontally along the bottom edge of the shovel 5 and is arranged for supporting the shovel 5 and for cutting or breaking ice and is attached to the horizontal bottom edge of the shovel 5 preferably with rivets 10. In addition the top edge of the shovel face 6 can include holes 6*a*, one on each end of the shovel face 6 and a ring at the top of a handle for the shovel for removably attaching a strap such as but not limited to a pet leash that has latches at each end and which latches are removably attached to one of holes on the shovel face 6 and at the other end of the strap or leash to the ring on top of the handle as seen in FIG. 7.

Figure 1:
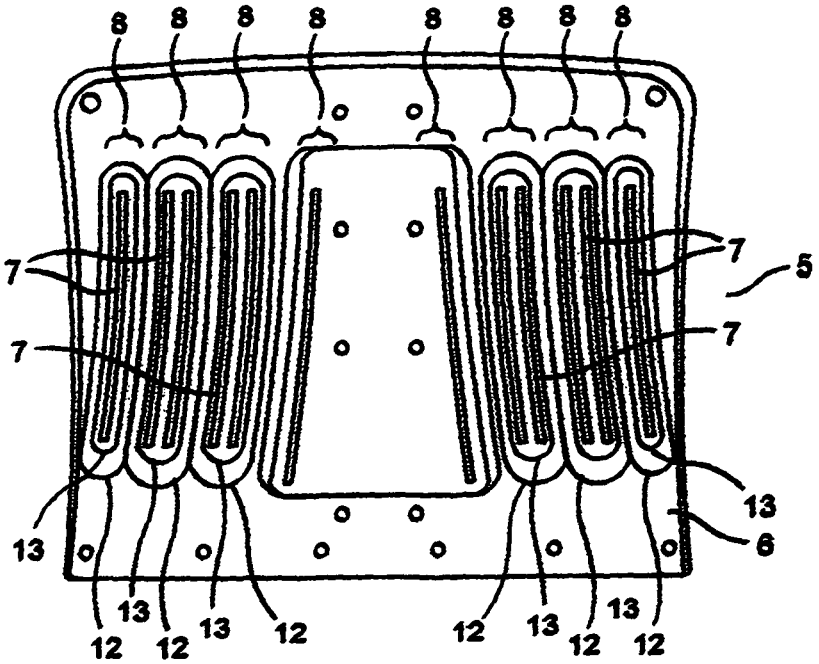
FIG. 1 shows a front face of the shovel of a first embodiment of the present invention with a curved surface.
Figure 2:
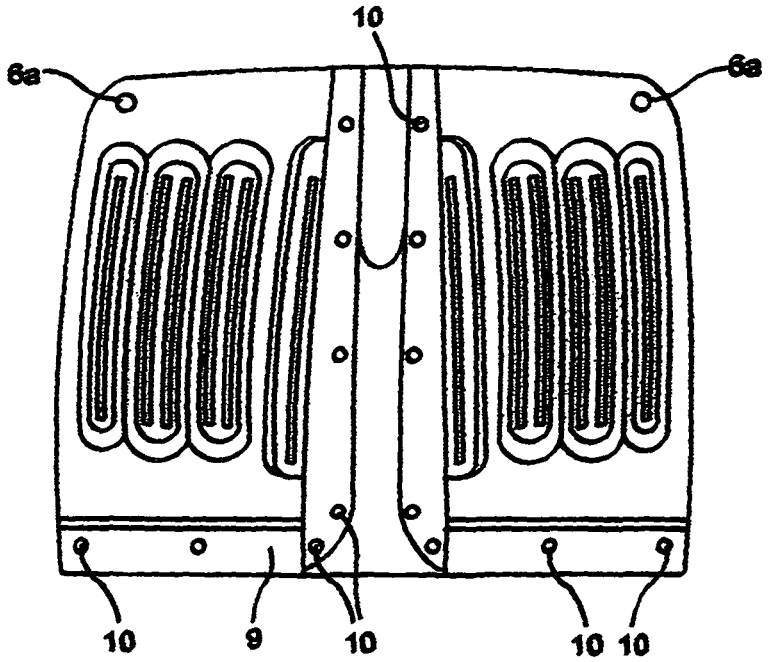
FIG. 2 shows a rear face of the shovel of the present invention with a curved surface.

In one embodiment of the present invention as shown in FIG. 1 the shovel 5 can be curved so that the face 6 of the shovel 5 is somewhat concave in its curvature. In FIG. 1 the curved shovel face or scoop portion 6 has beveled raised areas 12 to define recesses 13 within which one of more of the slots 5 are located. The raised or beveled areas 12 provide for further reduction of snow to shovel and also provide for additional support for overall shovel strength. These beveled areas 12 and recesses 13 can also be seen from the rear side of the shovel 5 in FIG. 2. The shovel in the embodiment of FIG. 1 can have the following preferred dimensions with it being understood that the invention is not limited to these dimensions but that they are being provided as an exemplary illustration. The shovel face 6 can have a width of approximately 18 inches and a length of approximately 15 inches as its minimum dimensions. The beveled raised areas 13 measure preferably 1 inch in width and 7 inches in length as minimum dimensions. The sets for the slots measure preferably ¼ inch each in width and extend for a minimum length of 7 inches long.

Figure 3:
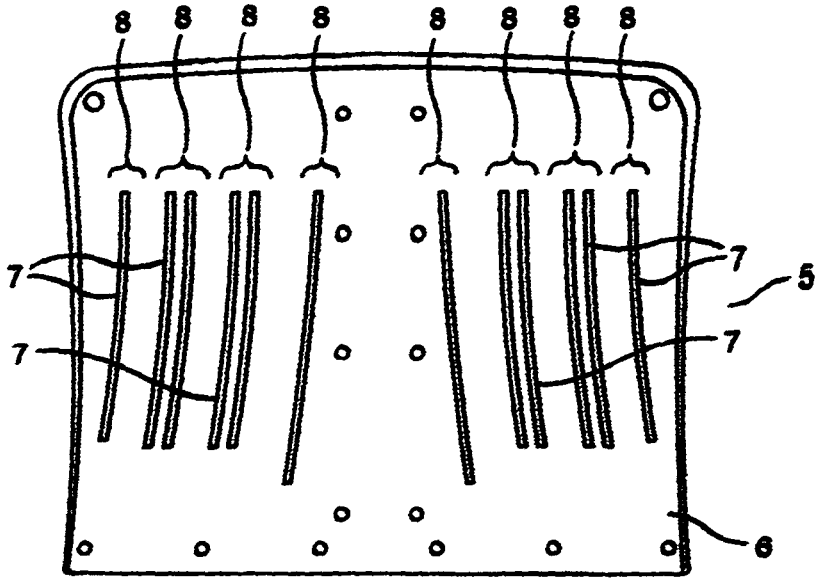
FIG. 3 shows a front face of the shovel of a second embodiment of the present invention with a curved surface.
Figure 4:
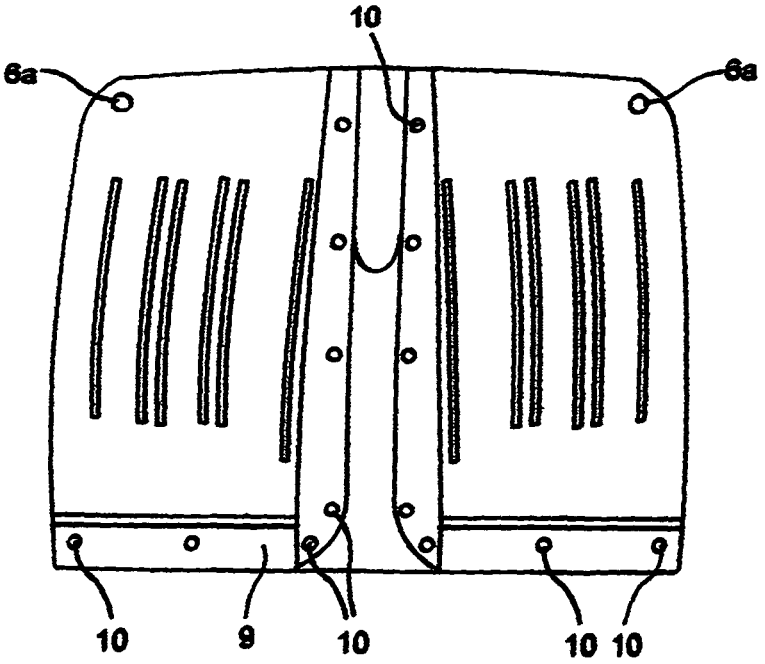
FIG. 4 shows a rear face of the shovel of the second embodiment present invention of FIG. 3.

In another embodiment of the present invention as shown in FIGS. 3 and 4 the shovel 5 can be flat instead of curved. In this embodiment the only difference from the first embodiment of Hal is that there is no need for raised beveled areas and defined recesses of the slits 7. Otherwise as is the case with the embodiment of FIG. 1, in the embodiment of FIGS. 3 and 4, the snow shovel 5 having a lace or blade scoop portion 6 that has an array of vertical or longitudinally extending slots or slits 7 that penetrate or go through the entire blade scoop portion 6 of the snow shovel 5 where the array is arranged with the slots 7 aligned vertically in a top to bottom arrangement. The slots 7 are disposed in a set 8 of preferably one to two slots 7 per set 8. The sets 8 of slots are arranged in a side to side fashion along the width of the face 6 of the shovel 5. The spacing of the slots 7 in each set 8 is less than the spacing between the sets 8 to ensure for support for the overall strength of the shovel 5 strength. Also the lengths of the slots 7 are only preferably no more than 75 percent of the length of the shovel faces 6 to also ensure for the overall strength of the shovel 5. The sets 8 of slots 7 are arranged in a symmetric pattern on the face 6 of the shovel 5 to ensure uniform distribution of the reduction of snow to the shovel 5 and to ensure uniformity of the overall strength of the shovel 5. Once again, an additional metal edge 9 is preferably provided horizontally along the bottom edge of the shovel 5 and is arranged for supporting the shovel 5 and for cutting or breaking ice and is attached to the horizontal bottom edge of the shovel 5 preferably with rivets 10.

Figure 5:
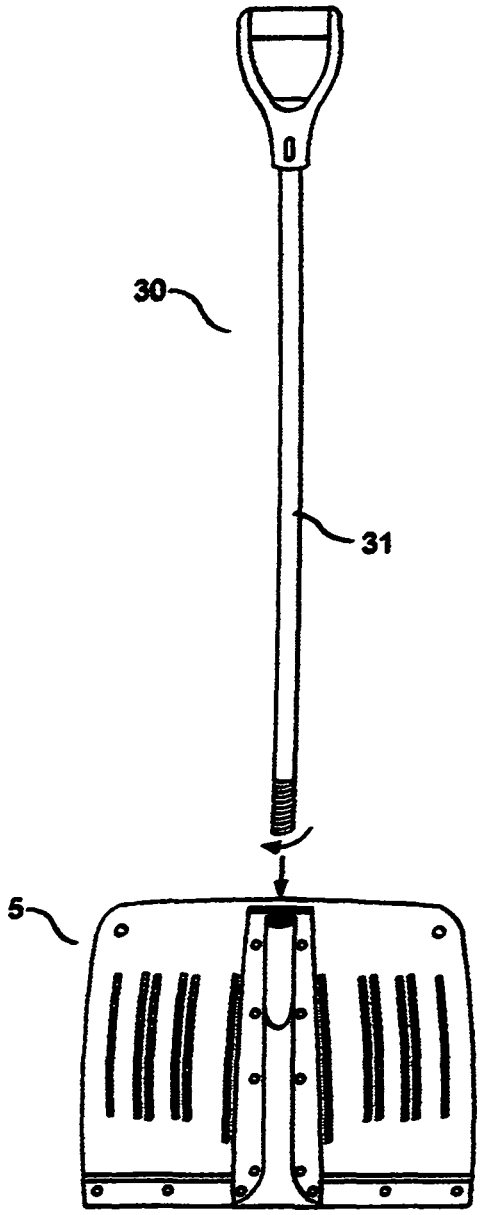
FIG. 5 shows the handle being attached to the top of the snow shovel of for either the embodiment of FIG. 1 or of FIG. 4.

FIG. 5 shows a handle 30 that can be preferably threadably attached to a threaded opening in the top portion of the snow shovel 5 in the embodiments of FIG. 1 and of FIG. 3. It is understood that the handle can be attached in any other suitable way or fashion known in the art.

Figure 6:
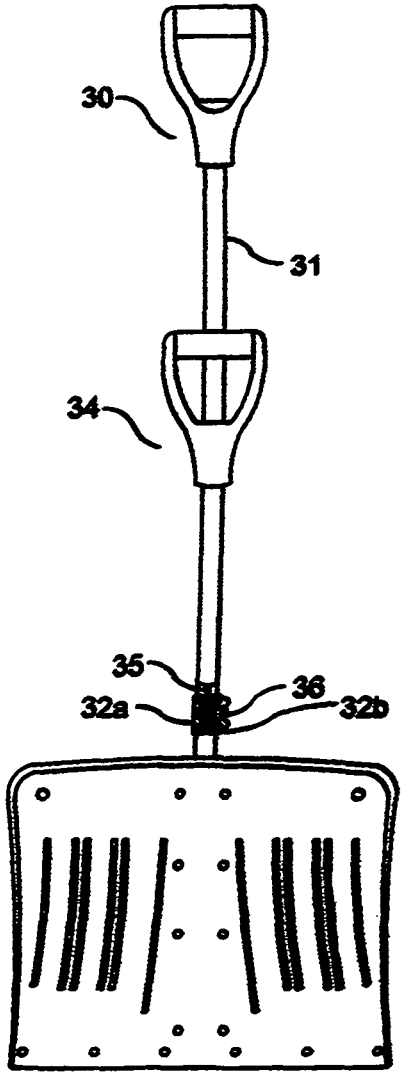
FIG. 6 shows another embodiment of present invention with second handle.
Figure 6A:
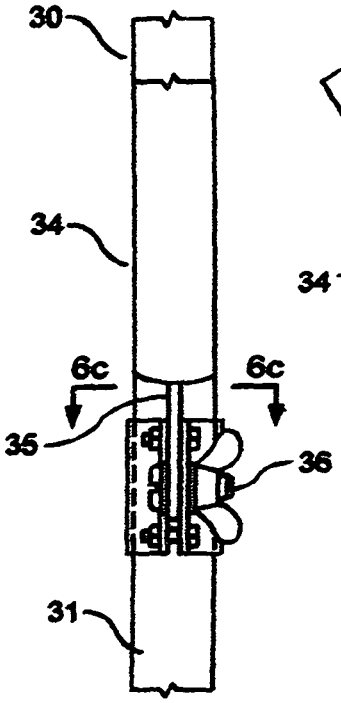
Figure 6B:
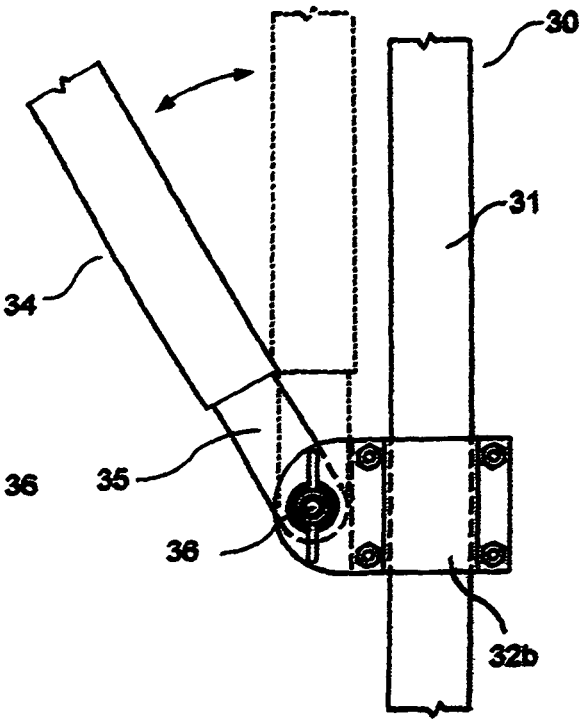
Figure 6C:
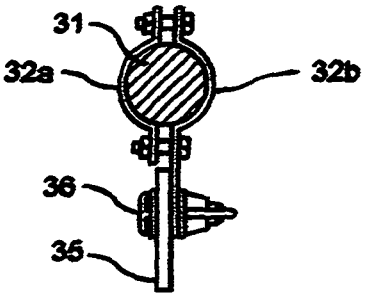

FIGS. 6A ,6*b* and 6C illustrate another embodiment for the handle portion that can be used in conjunction with the shovel of FIGS. 1-5 of the present invention. In this embodiment second handle can connected or coupled so as to provide for a better, more comfortable positioning of the shovel during shoveling by a user. The first handle 30 has a pole 31 or elongated portion 31 that is coupled around its perimeter by two C clamps 32*a* and 32*b* (see FIG. 6C) and is held in place in-between the securely clamped c-clamps as shown in FIGS. 6A and 6B. There is a second handle 34 having a second pole 35 is positioned at an angle from the longitudinal direction of the first handle's pole 31 and is connected by a bolt 36 going through one of the c clamps 32*a* or 32*b* into the pole 35 of the second handle 34 as shown in FIG. 6B. The second handle 34 can be adjusted by loosening or tightening the bolt 36 (see FIG. 6C) fastening the second handle to the c clamp to adjust the angle of the pole 35 of the second handle 34 and in this way adjusting the angle at which the shovel is held by a user (see FIG. 6B). This helps a user to adjust the shovel to a more comfortable position for shoveling.

While presently preferred embodiments have been described for purposes of the disclosure, numerous changes in the arrangement of method steps and apparatus parts can be made by those skilled in the art. Such changes are encompassed within the spirit of the invention as defined by the appended claims.

What is claimed is:

1. A snow shovel comprising:

Said snow shovel having a blade that has a generally rectangular shape being bounded by a left edge, a right edge, a top edge, and a bottom edge, of said bottom edge of said blade and said blade also having a front face and a rear face and has on its front face an array of vertical or longitudinally extending slits penetrating through said entire blade through said front face and said rear face, said slits being arranged in an array with said slits being aligned vertically in a top to bottom arrangement and being disposed in sets of one to two slits per set;

said sets of slits being arranged side to side with respect to each other along a width of said face of said shovel; said sets of slits being arranged in a symmetric pattern of said pattern of said slits of one to two slits per set contained within the boundaries of said front and rear faces so as not to extend all the way to a bottom edge of said front and rear faces of said shovel to ensure uniform distribution of the reduction of suction of snow to the shovel for releasing the snow from the front face of the blade of the shovel and to ensure uniformity of the overall strength of the shovel.

2. The snow shovel according to claim 1 wherein said symmetric pattern is arranged symmetrically with respect to a center of said front side of said shovel so that an arrangement of sets of slits on a left side of said face of said shovel is symmetrically matched on a right side of said center of said front side of said shovel to ensure uniform distribution of the reduction of suction of snow to said shovel and to ensure uniformity of an overall strength of said shovel.

3. The snow shovel according to claim 1 wherein a spacing of said slits in each of said sets is less than a spacing between said sets to ensure support for the overall strength of the shovel strength.

4. The snow shovel according to claim 1 wherein said slits have lengths that are no more than 75 percent of a length of said shovel face to ensure for an overall strength of said shovel.

5. The snow shovel according to claim 1 wherein a metal edge is provided horizontally along a bottom edge of said front side of said shovel for supporting the shovel and for cutting or breaking ice.

6. The snow shovel according to claim 1 wherein the shovel is curved so that the front side of the shovel 5 is somewhat concave in its curvature.

7. The snow shovel of claim 1 wherein the shovel front face has beveled raised areas defining recesses and each of said sets of one or more slits are located within a respective one of said recesses to provide additional support for overall shovel strength.

8. The snow shovel according to claim 1 wherein the shovel is flat so that the front face of the shovel is flat.

9. The snow shovel according to claim 1 further comprising a first handle has one end that is secured within an opening of a top portion of said shovel and a second handle, said second handle being connected or coupled to the shovel; said first handle having a pole or an elongated portion that is coupled around its perimeter by two C clamps said second pole being positioned at an angle from a longitudinal direction of said first handle's pole and being connected by another bolt going through another of the C clamps into the pole of said second handle wherein said second handle can be adjusted by loosening or tightening the bolt fastening the second handle of the C clamp to adjust the angle of the pole of said second handle and in this way adjusting the angle at which said shovel is held by a user thereby helping a user to adjust the shovel to a more comfortable position for shoveling.

10. The snow shovel according to claim 1 wherein some of said sets have one slit and some of said sets have two slits.

11. The snow shovel according to claim 1 wherein said slits are substantially parallel to each other and are rectangularly shaped.

12. The snow shovel according to claim 1 wherein the shovel is curved so that the front face of the shovel is curved.

13. The snow shovel according to claim 1 wherein said slits each have a uniform width.

14. A snow shovel comprising:

Said snow shovel having a blade that has a front face and a rear face and has on its front face an array of vertical or longitudinally extending slits penetrating through said entire blade through said front face and said rear face, said slits being arranged in an array with said slits being aligned vertically in a top to bottom arrangement and being disposed in sets of one to two slits per set;

said sets of slits being arranged side to side with respect to each other along a width of said face of said shovel; said sets of slits being arranged in a symmetric pattern of said pattern of slits of one to two slits per set on the face of the shovel to ensure uniform distribution of the reduction of suction of snow to the shovel for releasing the snow from the front face of the blade of the shovel and to ensure uniformity of the overall strength of the shovel; and said front face of said shovel having has beveled raised areas defining recesses and each of said sets of one or more slits are located within a respective one of said recesses to provide additional support for overall shovel strength.

* * * * *